US011220845B2

(12) United States Patent
Newman

(10) Patent No.: US 11,220,845 B2
(45) Date of Patent: Jan. 11, 2022

(54) POWERED SASH LOCK AND CONTROL SYSTEMS THEREFOR

(71) Applicant: Amesbury Group, Inc., Amesbury, MA (US)

(72) Inventor: Gary Newman, Valley Springs, SD (US)

(73) Assignee: Andersen Corporation, Bayport, MN (US)

( * ) Notice: Subject to any disclaimer, the term of this patent is extended or adjusted under 35 U.S.C. 154(b) by 529 days.

(21) Appl. No.: 14/989,766

(22) Filed: Jan. 6, 2016

(65) Prior Publication Data

US 2016/0356059 A1 Dec. 8, 2016

Related U.S. Application Data

(60) Provisional application No. 62/172,665, filed on Jun. 8, 2015.

(51) Int. Cl.
*E05B 47/00* (2006.01)
*E05C 3/04* (2006.01)
(Continued)

(52) U.S. Cl.
CPC ..... *E05B 47/0012* (2013.01); *E05C 3/046* (2013.01); *E05B 65/0811* (2013.01); *E05B 65/0835* (2013.01); *E05B 2047/002* (2013.01); *E05B 2047/0013* (2013.01); *E05C 3/30* (2013.01); *E05C 3/36* (2013.01); *E05C 9/063* (2013.01); *E05C 2007/007* (2013.01); *Y10S 292/47* (2013.01); *Y10T 292/0823* (2015.04); *Y10T 292/0843* (2015.04); *Y10T 292/0856* (2015.04); *Y10T 292/0916* (2015.04); *Y10T 292/0964* (2015.04); *Y10T 292/0966* (2015.04); *Y10T 292/1018* (2015.04); *Y10T 292/1021* (2015.04); *Y10T 292/1041* (2015.04); *Y10T 292/1077* (2015.04); *Y10T 292/1079* (2015.04);
(Continued)

(58) Field of Classification Search
CPC ..... E05B 47/0012; E05B 2047/0013; E05B 2047/002; E05B 65/0835; E05B 65/0811; E05C 3/046; E05C 2007/007; E05C 9/063; E05C 3/30; E05C 3/36; Y10T 292/1018; Y10T 292/307; Y10T 292/699; Y10T 292/1021; Y10T 292/0964; Y10T 292/0966; Y10T 292/0967; Y10T 292/1077; Y10T 292/0823; Y10T 292/0843; Y10T 292/0856; Y10T 292/0916; Y10T 292/1079; Y10T 292/306; Y10T 292/308; Y10T 292/1041; Y10S 292/47
USPC .... 292/DIG. 47, 142, 279, 341.16, 159–161, 292/197, 144; 74/661, 89.14, 665 D
See application file for complete search history.

(56) References Cited

U.S. PATENT DOCUMENTS 3,706,467 A 12/1972 Martin
3,811,718 A 5/1974 Bates
(Continued)

*Primary Examiner* — Kristina R Fulton
*Assistant Examiner* — Faria F Ahmad
(74) *Attorney, Agent, or Firm* — Mueting Raasch Group

(57) ABSTRACT

A system for locking a position of an operable sash in a window frame has a motor, a rotating element connected to the motor, and a sweep cam. The sweep cam is configured to rotatably engage a keeper disposed on a sash disposed opposite the operable sash. A spur gear operatively connects the rotating element to the sweep cam.

20 Claims, 9 Drawing Sheets

(51) Int. Cl.

| | |
|---|---|
| ***E05C 7/00*** | (2006.01) |
| ***E05C 3/36*** | (2006.01) |
| ***E05B 65/08*** | (2006.01) |
| ***E05C 9/06*** | (2006.01) |
| ***E05C 3/30*** | (2006.01) |

(52) U.S. Cl.
CPC ..... *Y10T 292/306* (2015.04); *Y10T 292/307* (2015.04); *Y10T 292/308* (2015.04); *Y10T 292/699* (2015.04)

(56) References Cited

U.S. PATENT DOCUMENTS 4,095,827 A 6/1978 Stavenau
4,095,829 A 6/1978 Van Klompenburg
4,163,375 A * 8/1979 Fujitaki ..... E05B 63/0017 292/142
4,493,235 A * 1/1985 Martin ..... B23D 25/12 83/303
4,736,972 A 4/1988 Mosch
4,763,936 A * 8/1988 Rogakos ..... E05B 81/14 292/201
4,796,932 A * 1/1989 Tame ..... E05B 81/20 292/112
4,801,164 A 1/1989 Mosch
4,806,712 A * 2/1989 Hoffman ..... E05B 85/26 200/302.1
4,813,725 A 3/1989 Mosch
4,881,436 A * 11/1989 Rommel ..... B26D 1/626 83/342
4,927,196 A * 5/1990 Girard ..... E05B 81/20 292/201
5,214,946 A * 6/1993 Antonello ..... E05B 63/0017 292/144
5,437,173 A * 8/1995 Spinar ..... E05B 17/0029 200/574
5,448,857 A 9/1995 Stormo
5,480,198 A * 1/1996 Wydler ..... E05B 47/0012 292/142
5,481,889 A * 1/1996 Richard ..... E05B 13/106 292/142
5,503,441 A * 4/1996 Schwaiger ..... E05B 81/25 292/142
5,582,445 A 12/1996 Olsen et al.
5,595,409 A * 1/1997 Fier ..... E05B 17/042 292/112
5,642,909 A * 7/1997 Swan ..... E05C 9/021 292/39
5,927,767 A * 7/1999 Smith ..... E05C 9/063 292/139
6,135,511 A * 10/2000 Smith ..... E05C 9/063 292/139
6,139,070 A * 10/2000 Piltingsrud ..... E05B 17/0029 292/144
6,142,541 A * 11/2000 Rotondi ..... E05C 3/046 292/241
6,161,881 A * 12/2000 Babka ..... E05C 9/021 292/26
6,302,455 B1 * 10/2001 Huang ..... E05B 47/0012 292/199
6,314,773 B1 * 11/2001 Miller ..... E05B 17/2084 292/142
6,550,825 B2 * 4/2003 Ostrowski ..... E05B 81/20 292/199
6,889,578 B2 * 5/2005 Spaziani ..... F16H 37/065 318/15
7,029,040 B2 * 4/2006 Lippoldt ..... B04B 7/06 292/122
7,237,811 B1 * 7/2007 Lawrence ..... E05B 17/0012 292/39
7,823,936 B2 * 11/2010 Compeau ..... G07F 9/10 292/201
8,269,627 B2 9/2012 Gore et al.
8,739,655 B2 * 6/2014 Bologna ..... B60K 17/08 74/661
8,757,677 B2 * 6/2014 Wintersteiger ..... E05B 47/023 292/201
9,038,317 B2 * 5/2015 Hansen ..... E05F 15/665 49/360
9,366,324 B2 * 6/2016 Huang ..... F16H 19/02
9,441,729 B2 * 9/2016 Skogward ..... F16H 61/32
9,701,397 B2 * 7/2017 Grand ..... B64C 13/341
9,719,278 B2 * 8/2017 Taylor ..... E05B 47/0001
2004/0113438 A1 * 6/2004 Kachouh ..... E05B 81/14 292/201
2008/0309099 A1 * 12/2008 Torben ..... E05B 17/0033 292/251.5
2009/0189398 A1 * 7/2009 Lawrence ..... E05B 65/0841 292/241
2010/0052337 A1 * 3/2010 Arabia, Jr. ..... E05B 81/14 292/216
2011/0140460 A1 * 6/2011 Segev ..... E05B 63/16 292/21
2013/0184112 A1 * 7/2013 Choi ..... F16H 37/0826 475/5
2020/0080344 A1 * 3/2020 Fullenwider ..... E05B 63/205

* cited by examiner

POWERED SASH LOCK AND CONTROL SYSTEMS THEREFOR

CROSS-REFERENCE TO RELATED APPLICATIONS

This application claims priority to and the benefit of U.S. Provisional Patent Application No. 62/172,665, filed Jun. 8, 2015, the disclosure of which is hereby incorporated by reference herein in its entirety.

BACKGROUND

Sliding windows are difficult to automate due to the lack of a reliable automatic system to lock the sash. Existing powered sash systems typically do not use sash locks due to the difficulty and negative aesthetics associated with locks. It is generally recognized, however, that window performance is compromised if a sash lock is not used. Manually rotated sash locks are typically not used on motorized hung windows because a user may forget to unlock the locks prior to window activation. This may damage the motors, drive system, or window itself. Thus, to prevent this damage, many installations do away with the sash locks entirely. This may leave the window vulnerable to breach, however.

SUMMARY

This system provides a way to automatically unlock and lock the sash with a motorized system. Two motors may be used, one on each side of the lock. This allows for the use of smaller motors, resulting in a lower profile and a symmetrical "look" for the lock. The system uses a standard cammed sweep lock so the lifting/pulling action is retained. This preserves the structural integrity and sealing characteristics of the window. The motor(s) drive a gear system that turns a sweep lock on a rail of a sash. In examples, the motor is powered using contacts on either side of the sash. An alternative system may utilize flex power or sensor cables attached to the sash at the pivot bars. The window control system may coordinate the movement of the lock mechanism and the sash. The powered systems may be implemented without negatively affecting the structural and sealing characteristics of the window.

In one aspect, the technology relates to a system for locking a position of an operable sash in a window frame, the system having: a motor; a rotating element connected to the motor; a sweep cam, wherein the sweep cam is configured to rotatably engage a keeper disposed on a sash disposed opposite the operable sash; and a spur gear operatively connecting the rotating element to the sweep cam. In an embodiment, the rotating element has at least one of a worm gear and a lead screw. In another embodiment, the sweep cam has a sweep cam gear engaged with the sweep cam, such that rotation of the sweep gear rotates the sweep cam. In yet another embodiment, the motor, the rotating element, the sweep cam, and the spur gear are disposed within a top rail of the operable sash. In still another embodiment, the system has a housing, wherein the motor, the rotating element, the sweep cam, and the spur gear are disposed within the housing and the housing is configured to be attached proximate a top rail of the operable sash.

In another embodiment of the above aspect, a contact is disposed on the housing, wherein the contact is communicatively connected to the motor. In an embodiment, a controller is disposed in the housing and a contact is disposed on the housing, wherein the controller is communicatively connected to the motor and the contact. In another embodiment, a switch is operatively connected to the motor.

In another aspect, the technology relates to a system having a motor having an output shaft disposed along an output shaft axis; a gear system operably connected to the motor; a sweep cam operably connected to the gear system, wherein the sweep cam is configured to rotate about a sweep cam axis substantially skew to the output shaft axis; and a controller operably connected to the motor for controlling an operation of the motor. In an embodiment, the gear system includes: a worm gear substantially coaxial with the output shaft axis and configured to be rotated by the output shaft axis; and a sweep cam gear configured to rotate based on a rotation of the worm gear, wherein the sweep cam gear is operably engaged with the sweep cam and substantially coaxial with the sweep cam. In another embodiment, the gear system further includes: a spur gear operably connected to the worm gear and operably connected to the sweep cam gear, wherein the spur gear has a spur gear axis substantially parallel to the sweep cam axis. In yet another embodiment, the controller includes at least one of an electronic controller and a switch. In still another embodiment, the sweep cam includes an integral sweep cam gear, wherein the sweep cam gear is configured to be operably engaged with the gear system.

In another embodiment of the above aspect, the spur gear has a plurality of spur gears. In an embodiment, the system further includes a position sensor. In another embodiment, the position sensor includes at least one of a rotary encoder, a proximity sensor, a hall effect sensor, a transducer, and a potentiometer. In yet another embodiment, at least a portion of the position sensor is disposed on at least one of the output shaft, the gear system, and the sweep cam. In still another embodiment, the system further includes a controller communicatively coupled to the position sensor.

In another aspect, the technology relates to a pair of motors; a worm gear disposed between the pair of motors; a pair of spur gears, each of the pair of spur gears offset from and operably engaged with the worm gear; a sweep cam gear disposed offset from and substantially between, and operably engaged with, the pair of spur gears; and a sweep cam operably engaged with the sweep cam gear. In an embodiment, the system further includes at least one of a controller and a switch for controlling at least one of the pair of motors.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

BRIEF DESCRIPTION OF THE DRAWINGS

The same number represents the same element or same type of element in all drawings.

DETAILED DESCRIPTION

Figure 1:
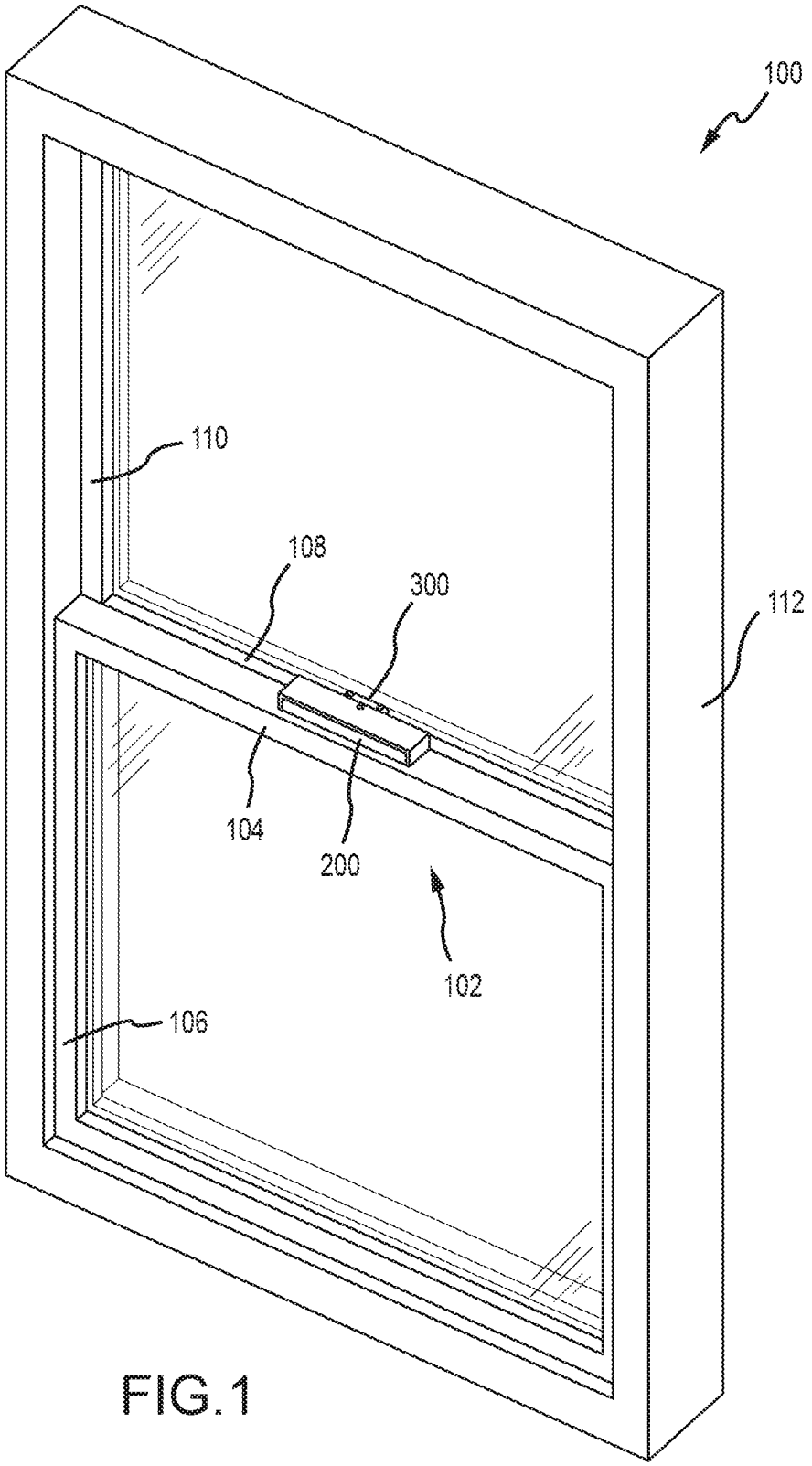
FIG. 1 is a perspective view of a window including a powered sash lock system.

FIG. 1 is a perspective view of a window 100 including a powered sash lock system 102. The system 102 includes a sash lock 200 that is typically disposed on a top rail 104 of a lower window sash 106. A corresponding keeper 300 of the system 102 is typically disposed on a bottom rail 108 of an upper window sash 110. Either or both of the lower sash 106 and the upper sash 110 are operable so as to slide vertically in a window frame 112. Of course, the powered sash lock systems described herein may also be used with window sashes that are configured to slide horizontally in a frame. Structure and function of examples of powered sash lock systems are described herein, as are control devices. The powered lock systems described herein may also be used on other types of sliding building elements, for example, sliding exterior doors, sliding cabinet doors, and so on.

Figure 2:
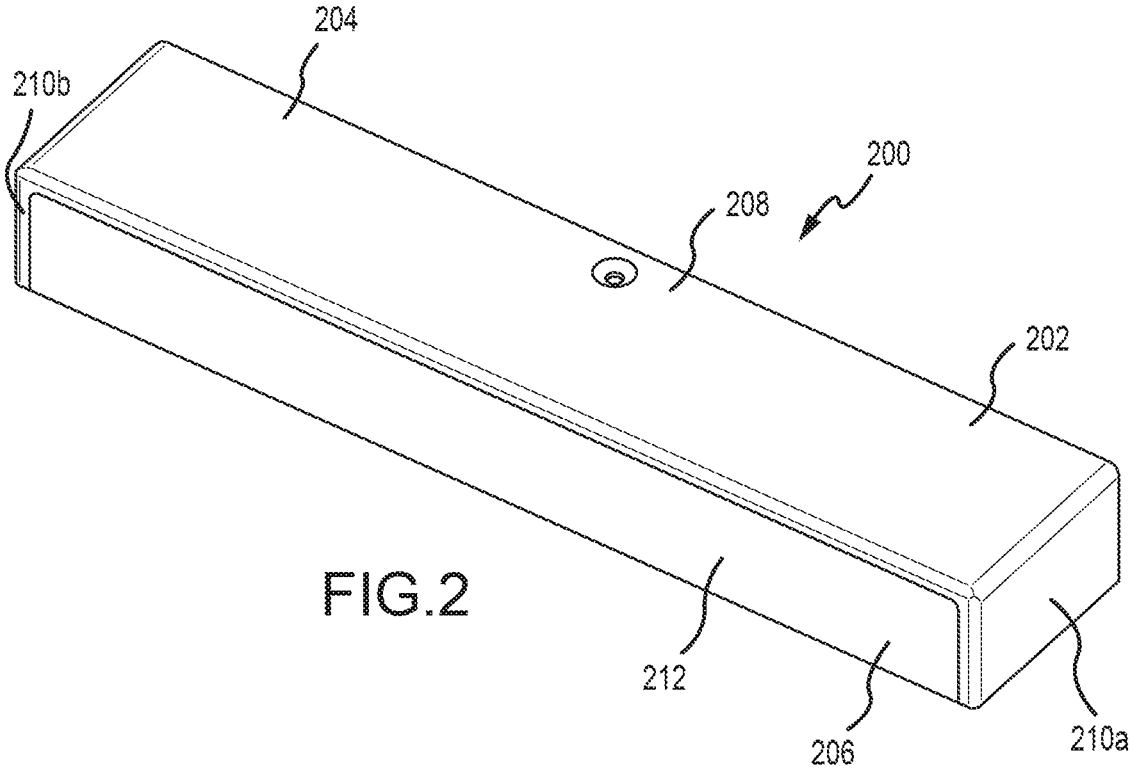
FIG. 2 is a perspective view of a sash lock used in conjunction with the powered sash lock system of FIG. 1.

FIG. 2 is a perspective view of a sash lock 200 used in conjunction with the powered sash lock system 102 of FIG. 1. The sash lock 200 may include a housing 202 that includes a first part 204 and a second part 206. In the depicted configuration, the first part 204 is a single piece that forms the top wall 208 and side walls 210*a*, 210*b* of the housing 202. The second part 206 forms a front wall 212 of the housing 202, as well as bottom and rear walls (not shown). The depicted housing 202 is configured to mounted to the window sash with one or more screws, bolts, adhesives, or other fixation elements. In other examples, the housing may be disposed wholly or partially within a rail of the window sash. If the sash lock is disposed completely or partially within the window sash, the housing may simply be frame in which the internal components are disposed. Such a configuration may include an access panel on a portion of the frame so as to allow access to the internal components. This access panel may be removable and configured so as to be flush or substantially flush with a surface of the rail. In examples, controls may be mounted on the housing 202 or remote therefrom, as described in more detail below.

Figure 3:
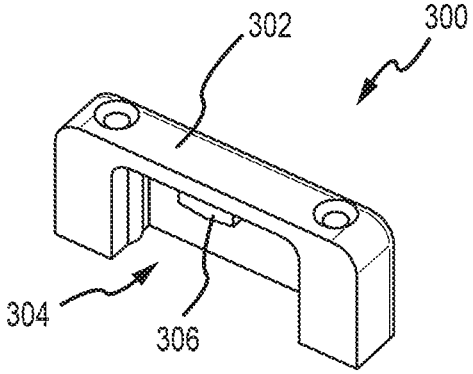
FIG. 3 is a perspective view of a keeper used in conjunction with the powered sash lock system of FIG. 1.

FIG. 3 is a perspective view of a keeper 300 used in conjunction with the powered sash lock system of FIG. 1. The keeper 300 generally includes a body 302 that at least partially defines a recess 304 that is configured to receive a cam that extends from the sash lock so as to lock the window. A catch 306 projects into the recess 304 and helps secure the cam. Like the sash lock above, the keeper 300 can have any configuration as required or desired to match the aesthetics of the window, secure the cam, and so on. Additionally, the keeper may be partially or wholly disposed within, as opposed to on, a rail of the window sash. In other examples, the keeper may be formed as an integral part of the rail. As such, other configurations of keepers are contemplated.

Figure 4:
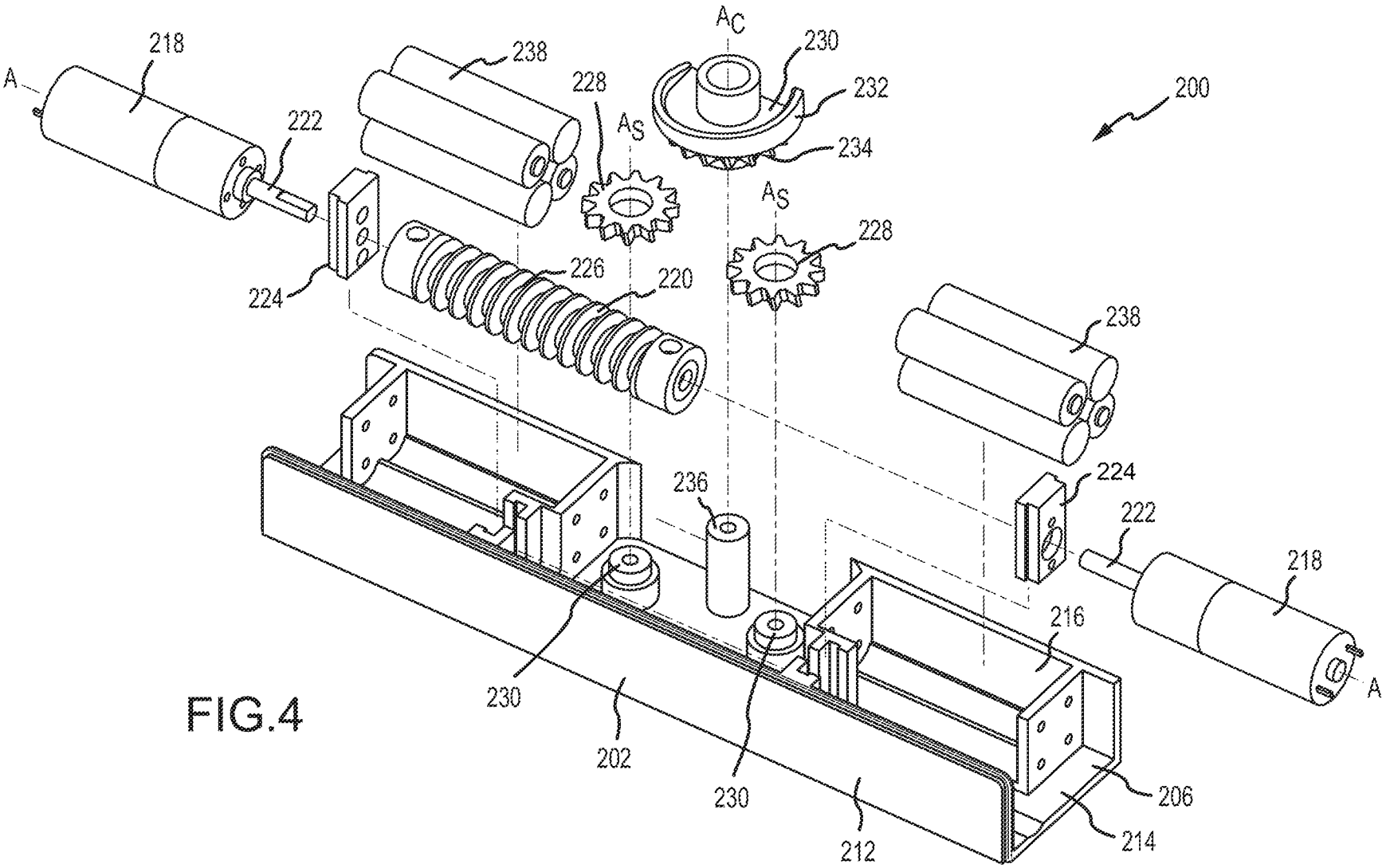
FIG. 4 is an exploded perspective view of one example of a sash lock used in conjunction with a powered sash lock system.

FIG. 4 is an exploded perspective view of one example of a sash lock 200 used in conjunction with a powered sash lock system. In this case, a first part (as depicted above) of the housing 204 has been removed, for clarity. The second part 206 of the housing that forms the front wall 212, the bottom wall 214, and the rear wall 216 remains. The portion 206 also includes a number of interior walls that define one or more interior chambers to house and support the various components, described in further detail below. The depicted sash lock 200 includes two motors 218 that are axially aligned along axis A. The motors 218, in certain examples, are DC motors. In other examples, only a single motor may be used. Two motors, however, may reduce the overall height of the sash lock 200, and can help ensure balanced forces acting on a rotating element 220, which forms a part of a gear system of the sash lock 200. Additionally, the use of two motors may reduce motor size and power requirements. In another example, each motor 218 may be dedicated to either a locking or unlocking function, or one motor 218 may serve as an emergency backup in the event of failure of the first motor 218. Other configurations and functions of multiple motors are contemplated. Shafts 222 extend from each motor 218 and penetrate alignment bushings 224 that are secured to one or more of the interior walls. Alternatively, the shafts 222 can penetrate an opening defined by a wall. The rotating element 220 may be a worm gear or lead screw having a continuous thread 226. The thread 226 has a pitch that enables it to engage one or more spur gears 228 that also form a part of the gear system. The spur gears 228 are mounted on shafts 230 that may be integral with or otherwise extend from the housing 202. A single spur gear may also be used, although the two spur gears 228 depicted may help balance forces generated by the gear system. A sweep cam 230 includes a ramp 232 configured to engage the associated keeper when extended from the housing 202 in a locking position. Disposed below the ramp 232 is a sweep cam gear 234 that may be integral with or connected to the cam 230. The sweep cam gear 234 forms a part of the gear system and is configured to engage the spur gears 228. The sweep cam 230 is mounted on a shaft 236 that may be integral with or otherwise extend from the housing 202. The sash lock 200 may include an onboard power system in the form of one or more batteries 238, or may be powered from a remote power source. Wires, circuit boards, and other control elements are not depicted in FIG. 4, but will be apparent to a person of skill in the art upon reviewing this disclosure.

Spur gear shafts 230 define spur gear shaft axes $A_S$, while the sweep cam shaft 236 defines a sweep cam shaft axis $A_C$. These axes $A_S$, $A_C$ are substantially parallel and skew relative to the axis A on which the motors 218 and rotating element 220 are aligned. In FIG. 4, axis A is substantially horizontal, while axes $A_S$, $A_C$ are substantially vertical. Additionally, the axes $A_S$, $A_C$ are skew relative to axis A. As such, the gear system translates the horizontal rotation generated by the motors 218 into a vertical rotation of the sweep cam 230. Other gear system configurations that translate rotation between one or more axes of rotation are contemplated.

Figure 5A:
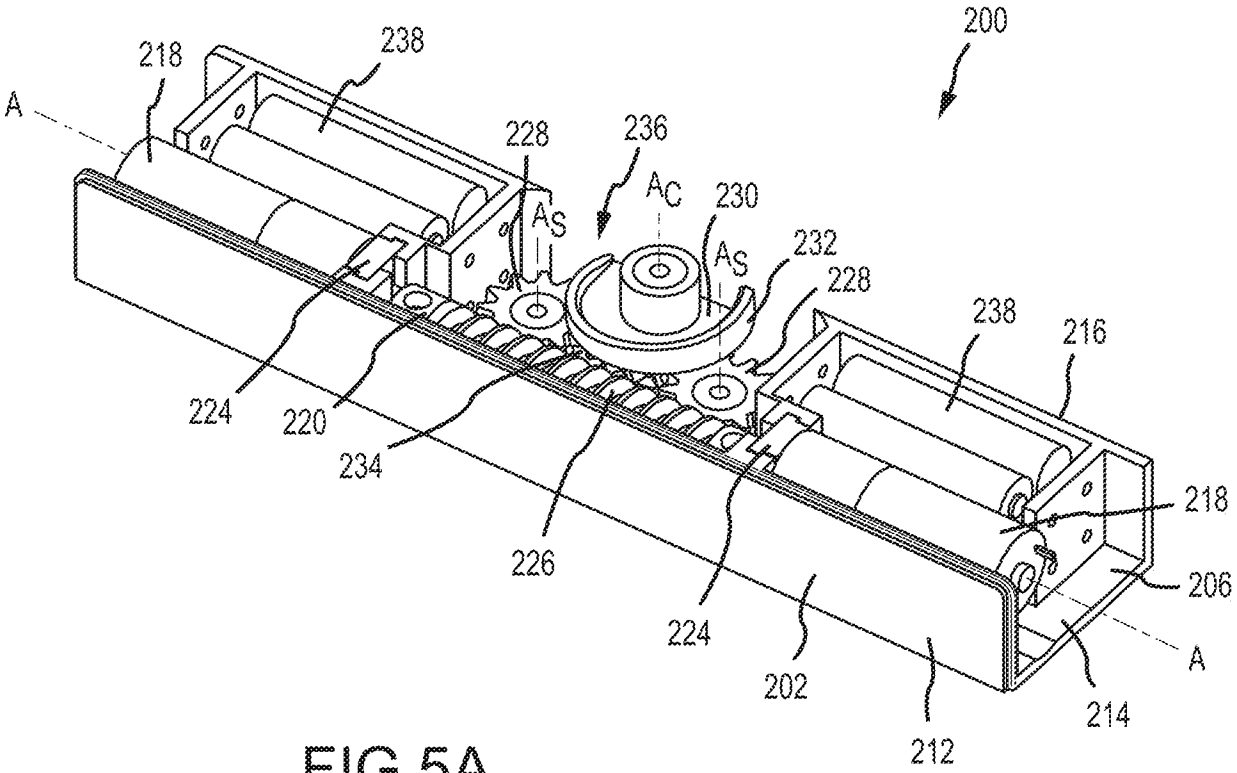
FIG. 5A is an upper perspective view of the sash lock of FIG. 4 in an unlocked position, with an upper housing removed.
Figure 5B:
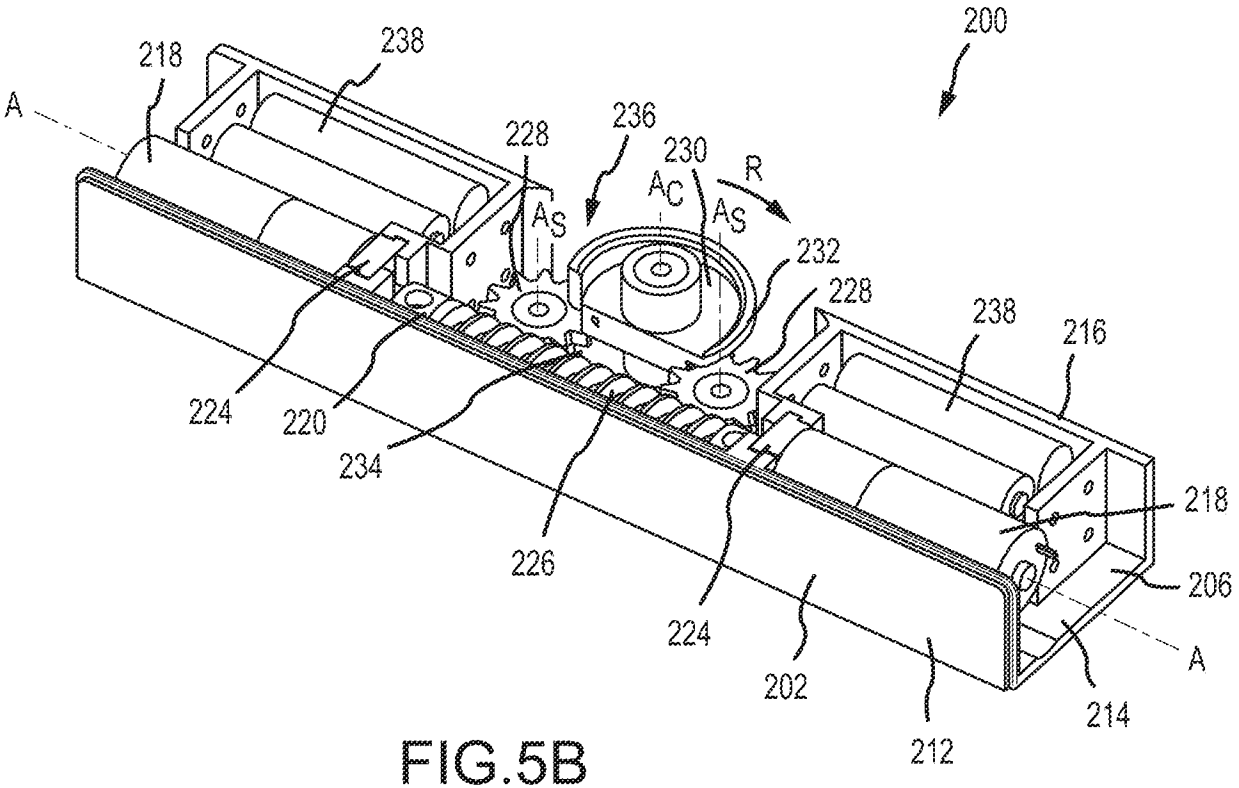
FIG. 5B is an upper perspective view of the sash lock of FIG. 4 in a locked position, with the upper housing removed.

FIG. 5A is an upper perspective view of the sash lock 200 of FIG. 4 in an unlocked position, with an upper housing removed. The components of the sash lock 200 depicted are described generally above with regard to FIG. 4. As such, not all components are described further below. As can be seen, the rear wall 216 defines an opening 236 through which the sweep cam 230 may extend. In the depicted configuration, however, the sweep cam 230 is retracted into the housing 202, and as such, the window sash is unlocked. In FIG. 5A, the spur gears 228 are engaged with the worm gear or lead screw 220. As such, rotation of the lead screw 220 due to action of the motors 218 will rotate the spur gears 228. The spur gears are engaged with the sweep cam gear 234 on the underside of the sweep cam 230 so as to rotate the sweep cam 230. FIG. 5B is an upper perspective view of the sash lock 200 of FIG. 4 in a locked position, with the upper housing removed. As can be seen the sweep cam 230 has rotated R out of the opening 236 so as to engage the associated keeper and lock the window.

As apparent from FIGS. 5A and 5B, the depicted housing 202 configuration has other advantages beyond protecting the internal components from dirt and damage. As depicted above, the first part of the housing 202 forms the top wall and side walls. By removing the first part, the various internal components are exposed and may be removed, replaced, or otherwise serviced. For example, the motors 218 can be removed axially along axis A without removing the alignment bushings 224. Batteries 238 may be removed and replaced. The spur gears 228 and sweep cam 230 may also be removed along their respective axes $A_S$, $A_C$. All this can be accomplished without having to remove the housing 202 from the window rail, which greatly improves serviceability and maintenance.

Figure 6A:
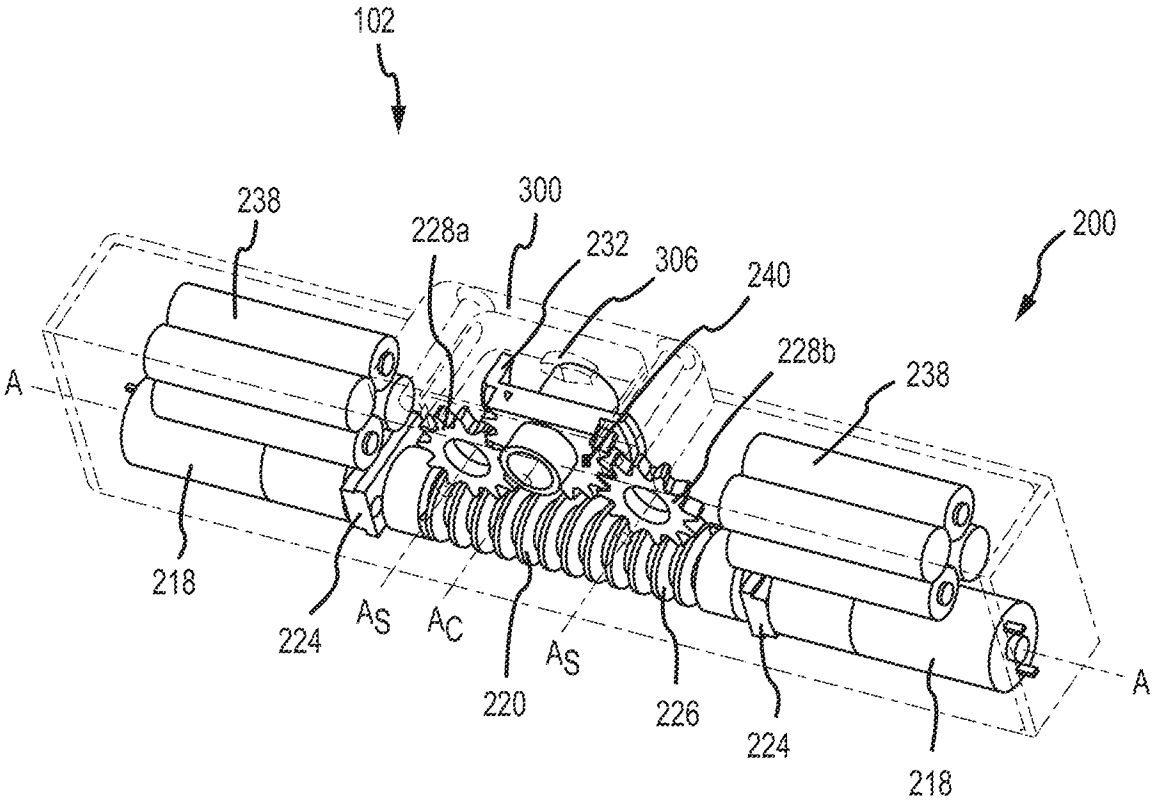
FIG. 6A is a lower perspective view of the sash lock of FIG. 4 in the unlocked position, with the housing hidden.
Figure 6B:
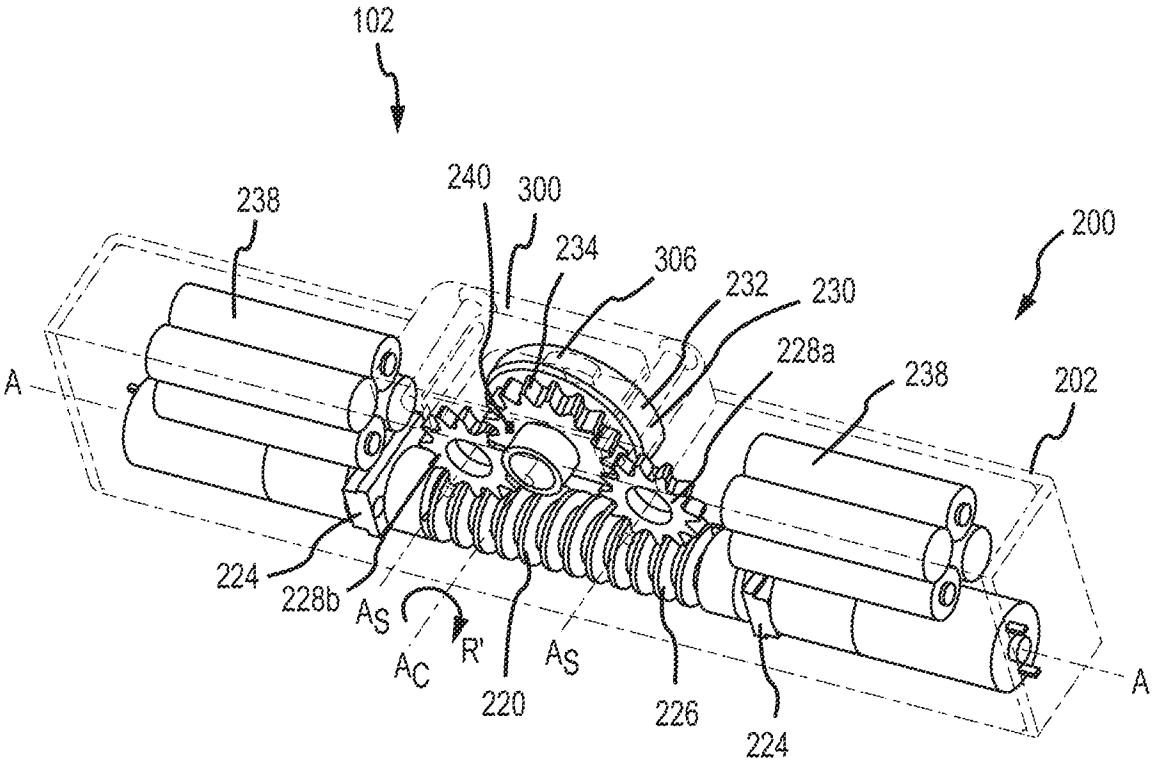
FIG. 6B is a lower perspective view of the sash lock of FIG. 4 in the locked position, with the housing hidden.

FIG. 6A is a lower perspective view of the sash lock 200 of FIG. 4 in the unlocked position, with the housing 202 hidden. In this unlocked position, the lock system 102 is not engaged and the associated window may be opened. FIG. 6B is a lower perspective view of the sash lock 200 of FIG. 4 in the locked position, with the housing hidden. In this configuration, the lock system 102 is locked, because the ramp 232 of the sweep cam 230 is engaged with the catch 306 on the keeper 300. As such, the window cannot be opened. To unlock the lock system 102 from the depicted locked position, the sweep cam 230 must be rotated about axis $A_C$ as depicted by R'. As can be seen then, the sweep cam gear 234 will only be engaged by the spur gear 228*b* at the beginning and end of the rotation R'. This may be advantageous, since engagement of the spur gear 228*b* at the beginning and the end of rotation may help overcome inertia forces in sash locks that have been in one position (locked or unlocked) for an extended period of time. For example, this may help release the ramp 232 from the catch 306. The other spur gear 228*a* is engaged with the sweep cam gear 234 during the majority, if not the entire, rotation R'. FIGS. 6A and 6B also depict a position sensor 240 disposed on the sweep cam gear 234. The position sensor 240 may be used by the controller to determine the position of the sweep cam gear 234 (and consequently, the sweep cam 230), so as to prevent over- or under-rotation thereof, or to ensure proper locking or operation. The position sensor 240 may be an optical, magnetic, proximity, or other type of sensor or an encoder such as a rotary encoder.

The windows on which the sash lock systems described herein can be mounted may be operable by a powered system or may be manually operated. If a powered system is used, the power and control for the sash lock may be integrated with the power and control of the powered window operation system. Control and power wiring may be disposed in the frame of the window and one or more rails of one or more sashes. In other examples, only control wiring need be utilized if the sash lock includes its own power supply, such as the batteries depicted herein.

Figure 7A:
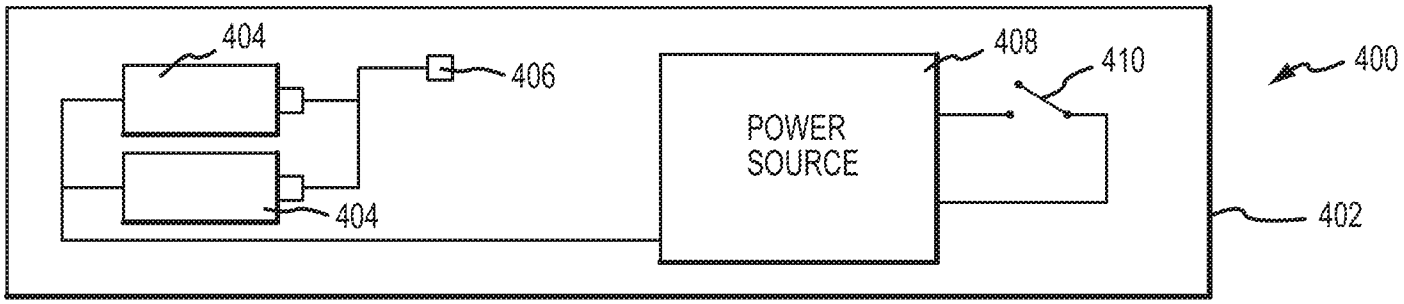
FIGS. 7A-7C are schematic wiring diagrams for examples of control systems for a powered sash lock system.

FIG. 7A is a schematic wiring diagram for one example of a control system 400 for a powered sash lock system. In this configuration, all powered and control components are disposed within the sash lock housing 402. These components include the motors 404, position sensor 406, and power source 408 (one or more batteries, as described above). A switch 410, in the form of a push button, toggle, or other device completes the circuit so as to actuate or otherwise control the motors 404. In another example, the switch 410 may be a contact such as the type described in FIGS. 7B and 7C. Rotational direction of the motors 404 may be controlled by the position sensor 406. When a first signal is sent from the position sensor 406, indicative of a first position of the sweep cam, the motors 404 may operate in a first direction. If a second signal is sent from the position sensor 406, indicative of a second position of the sweep cam, the motors 404 may operate in a second direction. The position sensor 406 may be in communication with or form in part of an electronic controller for the sash lock system. It may also be disposed elsewhere on the gear system, the output shaft(s) of the motor(s), the sweep cam, and so on.

Figure 7B:
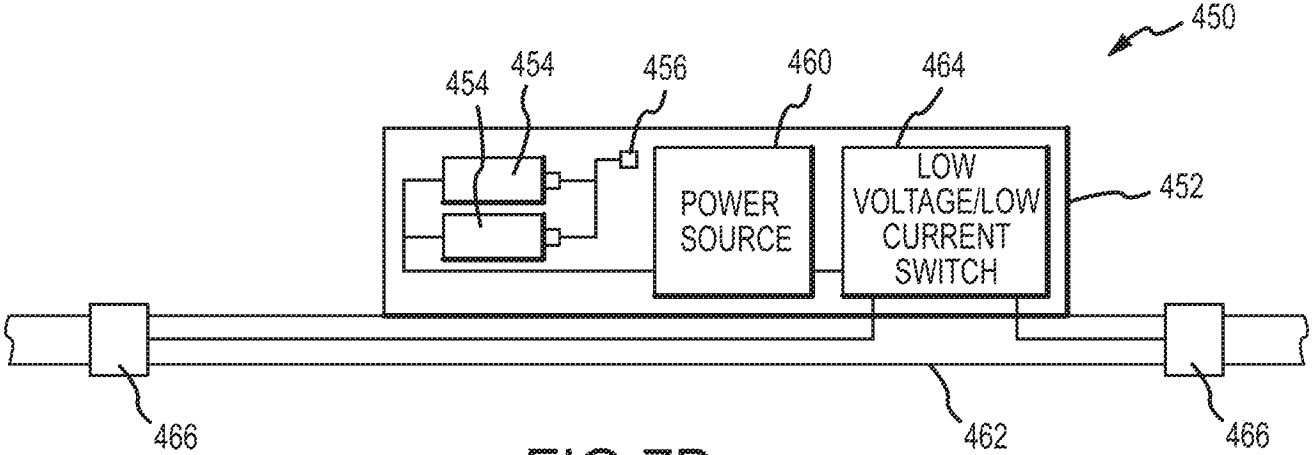

FIG. 7B is a schematic wiring diagram for another example of a control system 450 for a powered sash lock system. In this configuration, powered components are disposed within a housing 452, while certain control components are disposed within a rail 462 of the window sash. Components disposed in the housing 452 include the motors 454, position sensor 456, and power source 458 (one or more batteries, as described above). Additionally, a low voltage/low current switch 464 is disposed within the housing 452 and forms a part of the control circuit. The control circuit includes one or more low voltage/low current contacts disposed on the rail 462. When touched by an operator of the window (for example, with the hands), the control circuit is complete (with the operator acting as a conductor for the low voltage/low current circuit). The switch 464 then sends a signal to the power source 460 so as to activate the motors 454. Thus, when lifting the sash, the operator may touch the contacts 466, which will actuate the motors 454 so as to unlock the window. The operator then may lift the window, e.g., without removing her hands from the contacts 466. After closing the window, the operator may again touch the contacts 466 so as to lock the window. Rotational direction of the motors 404 may be controlled by the position switch 456, as described above. In another example, the contacts 466 may be disposed on the housing 452 itself, and touched as needed to lock or unlock the sash lock system.

Figure 7C:
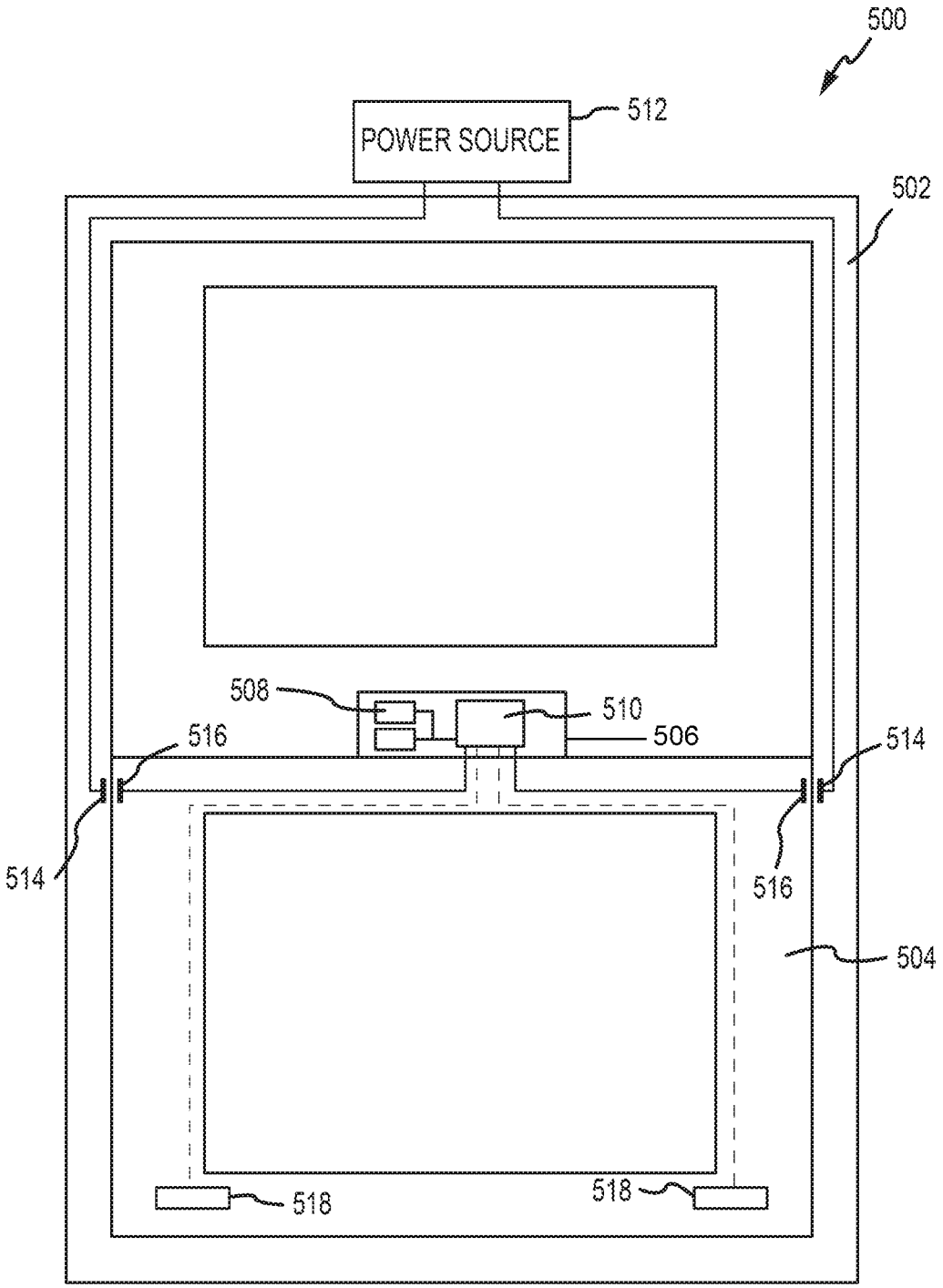

FIG. 7C is a schematic wiring diagram for another example of a control system 500 for a powered sash lock system. Here, a window frame 502 is depicted, having a sash 504 slidably disposed therein. A housing 506 of a sash lock, such as the types described herein, is fixed to the sash 504. The housing 506 contains a plurality of motors 508, as well as a low voltage/low current switch 510. In this configuration, a power source 512 is located remote from the housing 506. In that case, the power source 512 may be associated with a powered window operation system, or may be a remote self-contained power source (e.g., a battery pack), or may be the building power system. The power source 512 is connected to a power circuit that includes two contacts 514 disposed on the frame 502. When contacts 516 disposed on the sash 504 are in contact with the frame contacts 514, the power circuit is complete and the sash lock may be operated. To operate the sash lock, the control system 500 includes two remote low voltage/low current contacts 518 that operate as described in FIG. 7B above. As such, if the window is closed and sash lock in the lock position, an operator first touches the low voltage/low current contacts 518 to unlock the sash lock. Once unlocked, the operator can raise the window sash 504. Since the power circuit is now incomplete due to the disengagement of contacts 514 and 516, the sash lock cannot be operated. As the operator closes the window sash 504, again with her hands on the low voltage/low current contacts 518, once the contacts 514 and 516 re-engage, the power circuit is complete and the sash lock is automatically locked. Again, as described above, operation of the motors 508 may be controlled by a position sensor (not shown). Other control configurations are contemplated and will be apparent to a person of skill in the art upon reading this disclosure.

The terms first, second, upper, lower, retracted, extended, locked, unlocked, etc., as used herein, are relative terms used for convenience of the reader and to differentiate various elements of the systems described herein from each other. In general, unless otherwise noted, the terms are not meant to define or otherwise restrict location of any particular element or operation of the window.

The materials utilized in the manufacture of the window lock system may be those typically utilized for window hardware manufacture, e.g., zinc, steel, brass, stainless steel, etc. Material selection for most of the components may be based on the proposed use of the lock system, level of security desired, etc. Appropriate materials may be selected for a lock system used on windows that have particular security requirements, as well as on lock systems subject to certain environmental conditions (e.g., moisture, corrosive atmospheres, etc.). Nylon, acetal, Teflon®, or combinations thereof may be utilized for various components (e.g., the sweep cam) to reduce friction, although other low-friction materials are contemplated. The housing may also be finished by known powder coating processes.

This disclosure describes some embodiments of the present technology with reference to the accompanying drawings, in which only some of the possible embodiments were shown. Other aspects may, however, be embodied in many different forms and should not be construed as limited to the embodiments set forth herein. Rather, these embodiments were provided so that this disclosure was thorough and complete and fully conveyed the scope of the possible embodiments to those skilled in the art.

Although specific embodiments were described herein, the scope of the technology is not limited to those specific embodiments. One skilled in the art will recognize other embodiments or improvements that are within the scope and spirit of the present technology. Therefore, the specific structure, acts, or media are disclosed only as illustrative embodiments. The scope of the technology is defined by the following claims and any equivalents therein.

What is claimed is:

1. A system for locking a position of an operable sash in a window frame, the system comprising:

a first motor and a second motor;

a rotating element configured to rotate about an element axis, the rotating element connected to the first motor and the second motor, wherein the first motor and the second motor are positioned on opposite ends of the rotating element along the element axis, and wherein the first motor and the second motor are configured to rotate the rotating element about the element axis when operated;

a sweep cam, wherein the sweep cam is configured to rotatably engage a keeper disposed on a sash disposed opposite the operable sash;

a sweep cam gear engaged with the sweep cam, wherein the sweep cam gear is pivotally rotatable about a sweep cam axis extending through a center of the sweep cam gear and through the sweep cam, such that rotation of the sweep cam gear about the sweep cam axis pivotally rotates the sweep cam about the sweep cam axis, wherein at least a portion of the sweep cam extends further from the sweep cam axis than an outer perimeter of the sweep cam gear, wherein the sweep cam and the sweep cam gear are fixed in position relative to each other about the sweep cam axis, and wherein the sweep cam and sweep cam gear rotate only about the sweep cam axis to engage the keeper; and a spur gear operatively connecting the rotating element to the sweep cam through the sweep cam gear, the spur gear rotating about a spear gear axis, wherein the spur gear axis is offset from the sweep cam axis.

2. The system of claim 1, wherein the rotating element comprises a worm gear or a lead screw.

3. The system of claim 1, wherein the first motor, the second motor, the rotating element, the sweep cam, and the spur gear are disposed within a top rail of the operable sash.

4. The system of claim 1, further comprising a housing, wherein the first motor, the second motor, the rotating element, the sweep cam, and the spur gear are disposed within the housing and the housing is configured to be attached proximate a top rail of the operable sash.

5. The system of claim 1, wherein the first motor and the second motor are aligned with each other along the element axis.

6. The system of claim 1, wherein the spur gear axis is aligned with the sweep cam axis.

7. A system for locking a position of an operable sash in a window frame, the system comprising:

a first motor and a second motor;

a rotating element configured to rotate about an element axis, the rotating element connected to the first motor and the second motor, wherein the first motor and the second motor are positioned on opposite ends of the rotating element along the element axis, and wherein the first motor and the second motor are configured to rotate the rotating element about the element axis when operated;

a sweep cam, wherein the sweep cam is configured to rotatably engage a keeper disposed on a sash disposed opposite the operable sash;

a sweep cam gear engaged with the sweep cam, wherein the sweep cam gear is pivotally rotatable about a sweep cam axis extending through a center of the sweep cam gear and through the sweep cam, such that rotation of the sweep cam gear about the sweep cam axis pivotally rotates the sweep cam about the sweep cam axis, wherein at least a portion of the sweep cam extends further from the sweep cam axis than an outer perimeter of the sweep cam gear, wherein the sweep cam and the sweep cam gear are fixed in position relative to each other about the sweep cam axis, and wherein the sweep cam and sweep cam gear rotate only about the sweep cam axis to engage the keeper;

a first spur gear operatively connecting the rotating element to the sweep cam through the sweep cam gear, wherein the first spur gear rotates about a first spur gear axis, and wherein the first spur gear meshes with both the rotating element and the sweep cam gear such that rotation of rotating element about the element axis rotates the first spur gear about the first spur gear axis and rotation of the first spur gear about the first spur gear axis rotates the sweep cam gear and the sweep cam about the sweep cam axis; and a second spur gear operatively connecting the rotating element to the sweep cam through the sweep cam gear, wherein the second spur gear rotates about a second spur gear axis, and wherein the second spur gear meshes with both the rotating element and the sweep cam gear such that rotation of rotating element about the element axis rotates the second spur gear about the second spur gear axis and rotation of the second spur gear about the second spur gear axis rotates the sweep cam gear and the sweep cam about the sweep cam axis.

8. The system of claim 7, wherein both of the first spur gear axis and the second spur gear axis are offset from the sweep cam axis.

9. The system of claim 7, wherein both of the first spur gear axis and the second spur gear axis are aligned with the sweep cam axis.

10. The system of claim 7, wherein both of the first spur gear axis and the second spur gear axis are offset from and aligned with the sweep cam axis.

11. The system of claim 7, wherein the element axis is substantially orthogonal to the sweep cam axis, the first spur gear axis, and the second spur gear axis.

12. The system of claim 11, wherein both of the first spur gear axis and the second spur gear axis are offset from and aligned with the sweep cam axis.

13. A system for locking a position of an operable sash in a window frame, the system comprising:

a motor;

a rotating element connected to the motor, wherein the motor is configured to rotate the rotating element about an element axis;

a sweep cam, wherein the sweep cam is configured to rotatably engage a keeper disposed on a sash disposed opposite the operable sash;

a sweep cam gear engaged with the sweep cam, wherein the sweep cam gear is pivotally rotatable about a sweep cam axis extending through a center of the sweep cam gear and through the sweep cam, such that rotation of the sweep cam gear about the sweep cam axis pivotally rotates the sweep cam about the sweep cam axis, wherein at least a portion of the sweep cam extends further from the sweep cam axis than an outer perimeter of the sweep cam gear, wherein the sweep cam and the sweep cam gear are fixed in position relative to each other about the sweep cam axis, and wherein the sweep cam and sweep cam gear rotate only about the sweep cam axis to engage the keeper;

a first spur gear operatively connecting the rotating element to the sweep cam through the sweep cam gear, wherein the first spur gear rotates about a first spur gear axis, and wherein the first spur gear meshes with both the rotating element and the sweep cam gear such that rotation of rotating element about the element axis rotates the first spur gear about the first spur gear axis and rotation of the first spur gear about the first spur gear axis rotates the sweep cam gear and the sweep cam about the sweep cam axis; and a second spur gear operatively connecting the rotating element to the sweep cam through the sweep cam gear, wherein the second spur gear rotates about a second spur gear axis, and wherein the second spur gear meshes with both the rotating element and the sweep cam gear such that rotation of rotating element about the element axis rotates the second spur gear about the second spur gear axis and rotation of the second spur gear about the second spur gear axis rotates the sweep cam gear and the sweep cam about the sweep cam axis.

14. The system of claim 13, wherein the motor comprises a first motor and wherein the system further comprises a second motor;

wherein the first motor and the second motor are positioned on opposite ends of the rotating element along the element axis, and wherein the first motor and the second motor are configured to rotate the rotating element about the element axis when operated.

15. The system of claim 13, wherein both of the first spur gear axis and the second spur gear axis are offset from the sweep cam axis.

16. A system for locking a position of an operable sash in a window frame, the system comprising:

a first motor and a second motor;

a rotating element configured to rotate about an element axis, the rotating element connected to the first motor and the second motor, wherein the first motor and the second motor are positioned on opposite ends of the rotating element along the element axis, and wherein the first motor and the second motor are configured to rotate the rotating element about the element axis when operated;

a sweep cam, wherein the sweep cam is configured to rotatably engage a keeper disposed on a sash disposed opposite the operable sash;

a sweep cam gear engaged with the sweep cam, wherein the sweep cam gear is pivotally rotatable about a sweep cam axis extending through a center of the sweep cam gear and through the sweep cam, such that rotation of the sweep cam gear about the sweep cam axis pivotally rotates the sweep cam about the sweep cam axis, wherein at least a portion of the sweep cam extends further from the sweep cam axis than an outer perimeter of the sweep cam gear, wherein the sweep cam and the sweep cam gear are fixed in position relative to each other about the sweep cam axis, and wherein the sweep cam and sweep cam gear rotate only about the sweep cam axis to engage the keeper; and a spur gear operatively connecting the rotating element to the sweep cam through the sweep cam gear, the spur gear rotating about a spur gear axis;

wherein the element axis is substantially orthogonal to the sweep cam axis and the spur gear axis.

17. The system of claim 16, wherein the first motor and the second motor are aligned with each other along the element axis.

18. The system of claim 16, wherein the spur gear axis is offset from the sweep cam axis.

19. The system of claim 16, wherein the spur gear axis is aligned with the sweep cam axis.

20. The system of claim 16, wherein the spur gear axis is offset from and aligned with the sweep cam axis.

* * * * *